US006301460B1

(12) United States Patent
Elliott

(10) Patent No.: US 6,301,460 B1
(45) Date of Patent: Oct. 9, 2001

(54) ALL-IN-ONE TONER CARTRIDGE

(75) Inventor: Bruce Elliott, Meridian, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/667,358

(22) Filed: Sep. 21, 2000

(51) Int. Cl.[7] ..... G03G 15/01; G03G 15/08
(52) U.S. Cl. ..... 399/262; 399/119; 399/227
(58) Field of Search ..... 399/262, 223, 399/226, 227, 119, 120, 110, 112; 222/DIG. 1

(56) References Cited

U.S. PATENT DOCUMENTS 5,557,381 * 9/1996 Sakamoto et al. ..... 399/262 X
5,768,662 * 6/1998 Sugihara et al. ..... 399/119
6,192,211 * 2/2001 Kimura ..... 399/227

FOREIGN PATENT DOCUMENTS 06-148968 * 5/1994 (JP) .
09-034208 * 2/1997 (JP) .
10-254229 * 9/1998 (JP) .

* cited by examiner

*Primary Examiner*—Sophia S. Chen

(57) ABSTRACT

An all-in-one toner cartridge for use in a printing device has toner containers that are operably associated to form a cylindrical toner cartridge designed for insertion into and removal from the printing device as a single unit. The all-in-one toner cartridge rotates within the device to deliver the different toners from the respective toner containers for exposure to a rotating toner transfer drum within the printing device.

20 Claims, 5 Drawing Sheets

ALL-IN-ONE TONER CARTRIDGE

TECHNICAL FIELD

This invention relates to toner cartridges, and specifically to color laser printer toner cartridges.

BACKGROUND

Color laser printers are typically designed and operated with four separate color toner cartridges, one each for the colors cyan, magenta, yellow, and black. Conventionally, the toner cartridges are installed into, or removed from, a printer one at a time. Additionally, each individual toner cartridge is typically a single use item that is disposed of when the toner is depleted.

When installed in a printer, the color toner cartridges are engaged in a toner cartridge carousel that rotates to deploy a specific toner cartridge within the printer as needed during a print job. Examples of such color printers having a toner cartridge carousel system include the Color LaserJet 8550 Printer manufactured by Hewlett Packard, and the Color Laser Printer, Phaser 780, manufactured by Tektronix (color printers by Xerox).

A laser printer has a microprocessor that controls a laser light beam, and directs the laser beam to electrically charge a surface material on the surface of a toner transfer drum. Each surface area of the drum that is electrically charged by the laser beam is a single dot that will facilitate printing toner on a print medium. The areas of the drum that are not electrically charged by the laser beam will not print toner on the print medium.

The printer rotates the toner cartridge carousel to position one of the four color toner cartridges next to the drum. As the drum rotates and passes next to the toner cartridge, the electrical charge on the surface of the drum attracts the toner which has an opposite static charge from that of the charge on the drum. The toner adheres to the drum in a pattern of small dots wherever the laser beam created an electrical charge on the surface of the drum.

The printer also passes a static electrical charge to a print medium as the medium passes through the printer. Typically the electrical charge applied to the print medium is the same (positive or negative) as the electrical charge on the surface of the toner transfer drum, except that the electrical charge on the print medium is stronger. The drum with the adhered toner turns and presses against the print medium as the medium is passed through the printer. The stronger electrical charge of the print medium pulls the toner off of the drum and onto the print medium. The print medium then passes through a fusing system where pressure and heat permanently bind the toner to produce a printed page.

FIG. 1 shows a color laser printer 10 with a conventional toner cartridge carousel configuration 20. The carousel configuration 20 includes four separate toner cartridges 22 (two toner cartridges are not shown), a carousel central component 24, and a toner cartridge engaging mechanism 26 to secure the toner cartridges 22 within the printer 10. The carousel central component 24 is integrated and mechanized with the color printer 10 and is not removable from the printer in the ordinary course of printer operation (e.g., removing and installing toner cartridges).

The carousel configuration 20 rotates the toner cartridges 22 as needed by the printer 10 during a print job. As illustrated in FIG. 1, only two of the four separate and individual toner cartridges 22(*a*) and 22(*b*) are visible from outside the printer, and only one toner cartridge 22(*a*) can be removed or inserted at any one time. Two of the toner cartridges 22 are inaccessible and not visible due to their location on the carousel 20 which rotates the cartridges behind the framework of the printer 10 during operation.

There remains the ever-present need to reduce the expenses incurred during the manufacture and operation of printing devices. In light of conventional color printing devices having four separate toner cartridges that require an independent carousel mechanism for operation, manufacturing expenses can be reduced with an improved toner cartridge assembly. Furthermore, in light of the toner cartridges being single use, disposable items, operating expenses can be reduced with an improved toner cartridge.

SUMMARY

An all-in-one toner cartridge for a printing device is designed as a single unit for installation and removal from the device. The toner cartridge includes multiple toner containers configured to store one or more toners, such as the color toners used in a color laser printer. The toner containers are optionally replaceable, independent sub-cartridges that are designed to fit together in such a manner that they form the toner cartridge into the shape of a cylinder. In addition, each toner container is optionally reusable—it can be independently refilled with toner via fill holes in each toner container.

The toner containers can be interconnected or interlocked along their adjacent edges, or at the point where the toner containers fit together to form the central axis of the cylinder. In the described embodiment, the toner cartridges are pie-shaped subcartridges that extend radially outward from the cylinder axis.

Alternatively, the toner cartridge can be embodied as a single unit having individual toner containers installed or formed within a housing to form a cylinder. The toner containers are pie-shaped and integrated or molded into the housing. Alternatively, the toner containers can also be independent subcartridges made to slide in and out of the housing for replacement purposes.

BRIEF DESCRIPTION OF THE DRAWINGS

The same numbers are used throughout the drawings to reference like features and coponents.

DETAILED DESCRIPTION

Figure 1:
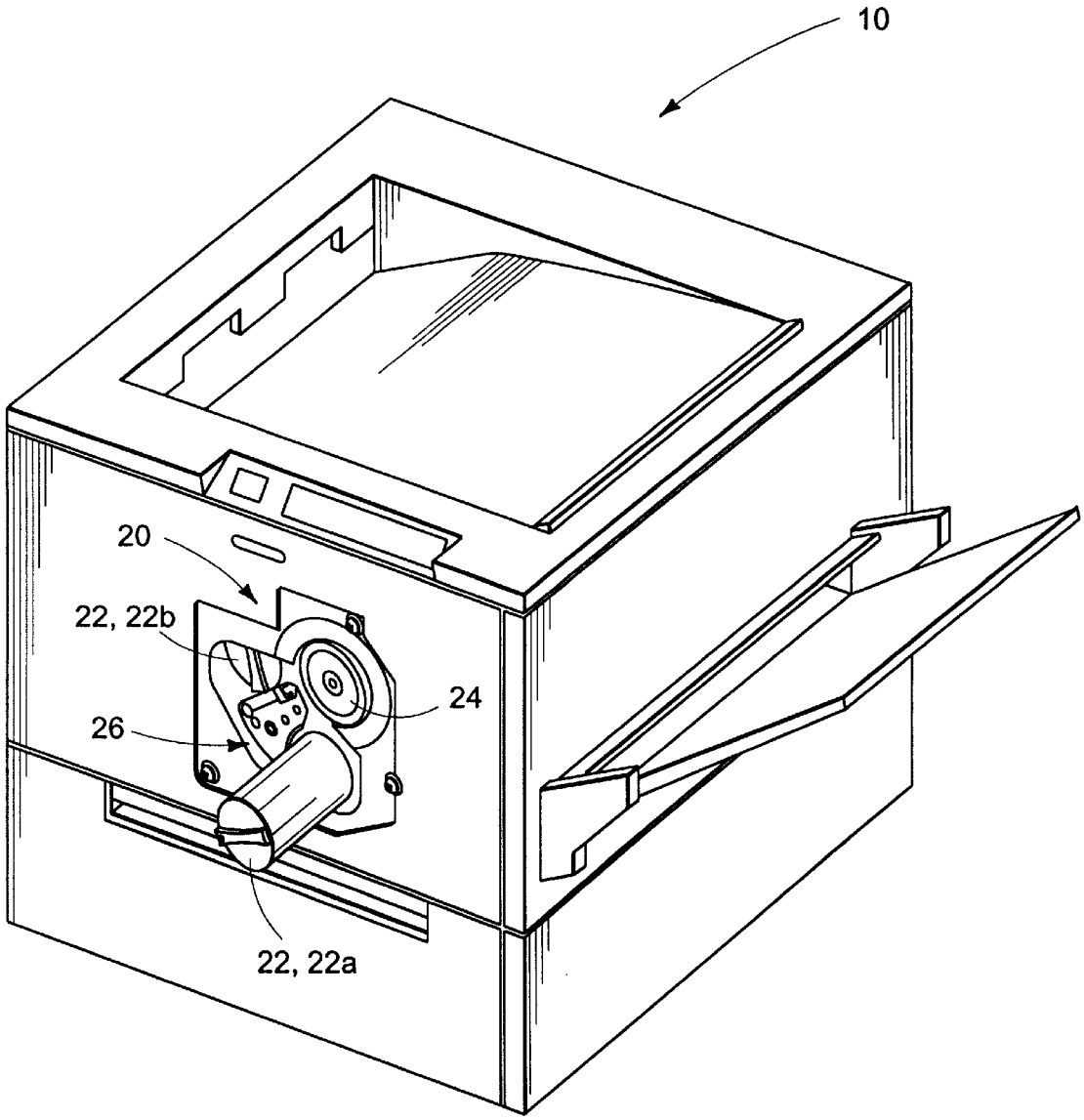
Fig. 1 Prior Art
FIG. 1 illustrates a color laser printer with a conventional toner cartridge carousel configuration.
Figure 2:
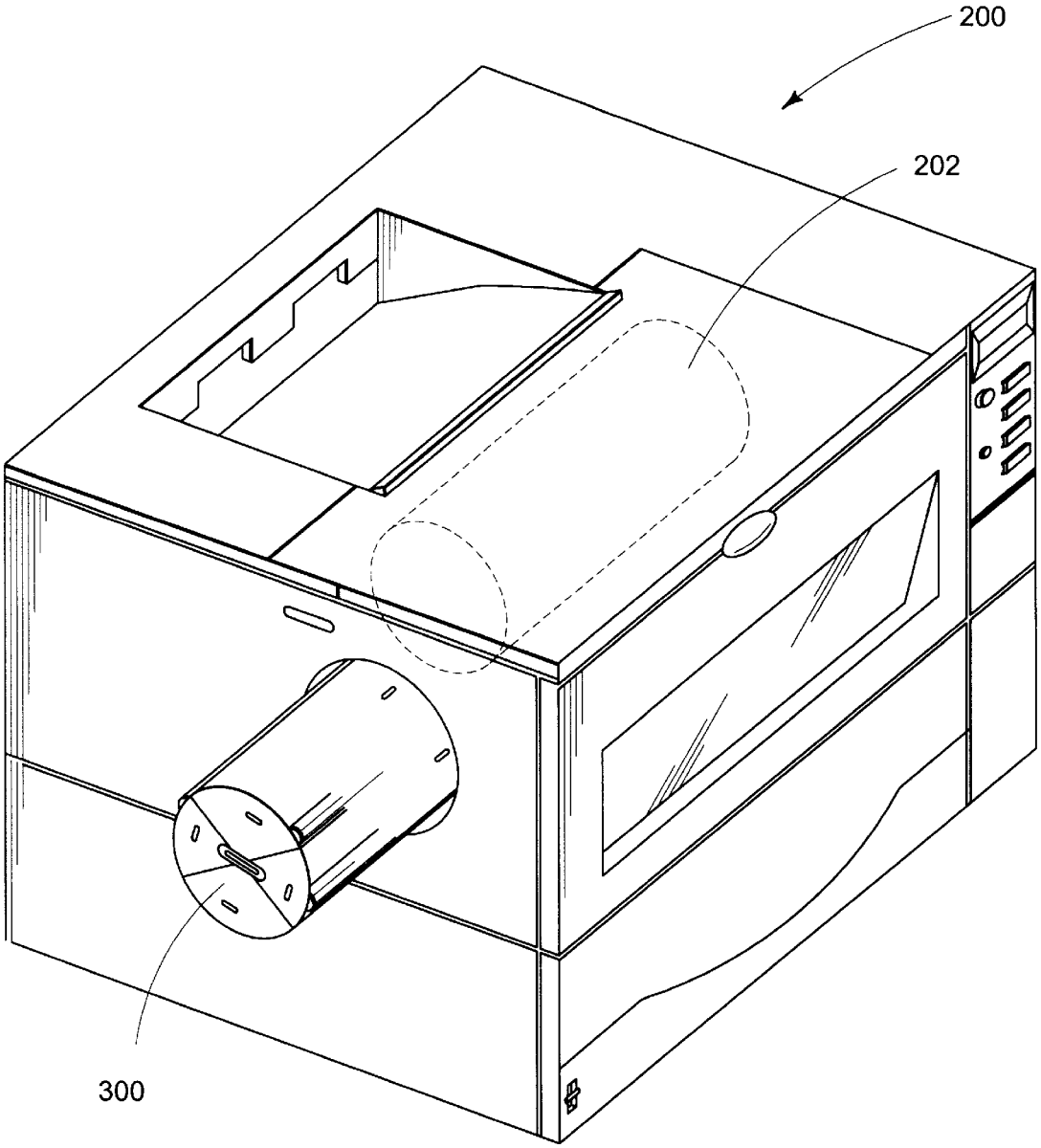
FIG. 2 illustrates the installation (and/or removal) of an all-in-one toner cartridge within a laser printer.

FIG. 2 shows a printing device 200. Printing device 200 in this embodiment is a color laser printer 200. However, the invention is also applicable to other types of printing devices such as scanners, photocopiers, facsimile machines, and the like. Many devices such as these utilize an optical/electrostatic process to transfer toner to a print medium.

FIG. 2 shows an all-in-one toner cartridge 300 being installed into, or removed from, the laser printer. The illustrated laser printer 200 is of the type described above, having a rotating toner transfer drum 202 that operates within the printer to apply toner to a print medium. More specifically, the drum 202 has a surface that is electrically charged to attract toner and to transfer the toner to a print medium, such as the printer paper.

The toner cartridge 300 has a plurality of individual containers which contain toners corresponding to different colors. The toner cartridge, with the different toners, is installed into the printer 200 as a single unit where it is engaged and rotated to expose the different toners to the rotating toner transfer drum 202.

The toner is delivered, or transferred, from the toner cartridge 300 to the toner transfer drum 202 by rotating the drum adjacent toner cartridge 300. Toner from within toner cartridge 300 is exposed to the surface of the drum by developer rollers that are integrated with the individual toner containers. As the drum rotates adjacent the toner, the charged areas of the drum attract the toner to the drum surface.

The toner is then transferred to a print medium such as a paper sheet. This is accomplished by passing the print medium adjacent the drum as it rotates. The drum 202 presses against the print medium as it is passed through the printer 300 and the print medium attracts the toner from the surface of the drum 202. Other mechanisms within printer 200 then fuse the toner to the print medium. The drum is at least as long as the print medium is wide. Toner cartridge 300 is formed as a cylinder and designed such that the length of the cylinder is at least as long as the width of the print medium. Ideally, the toner cartridge 300 is as long as the toner transfer drum 202 to facilitate exposing the entire length of the drum 202 to the toner.

Figure 3:
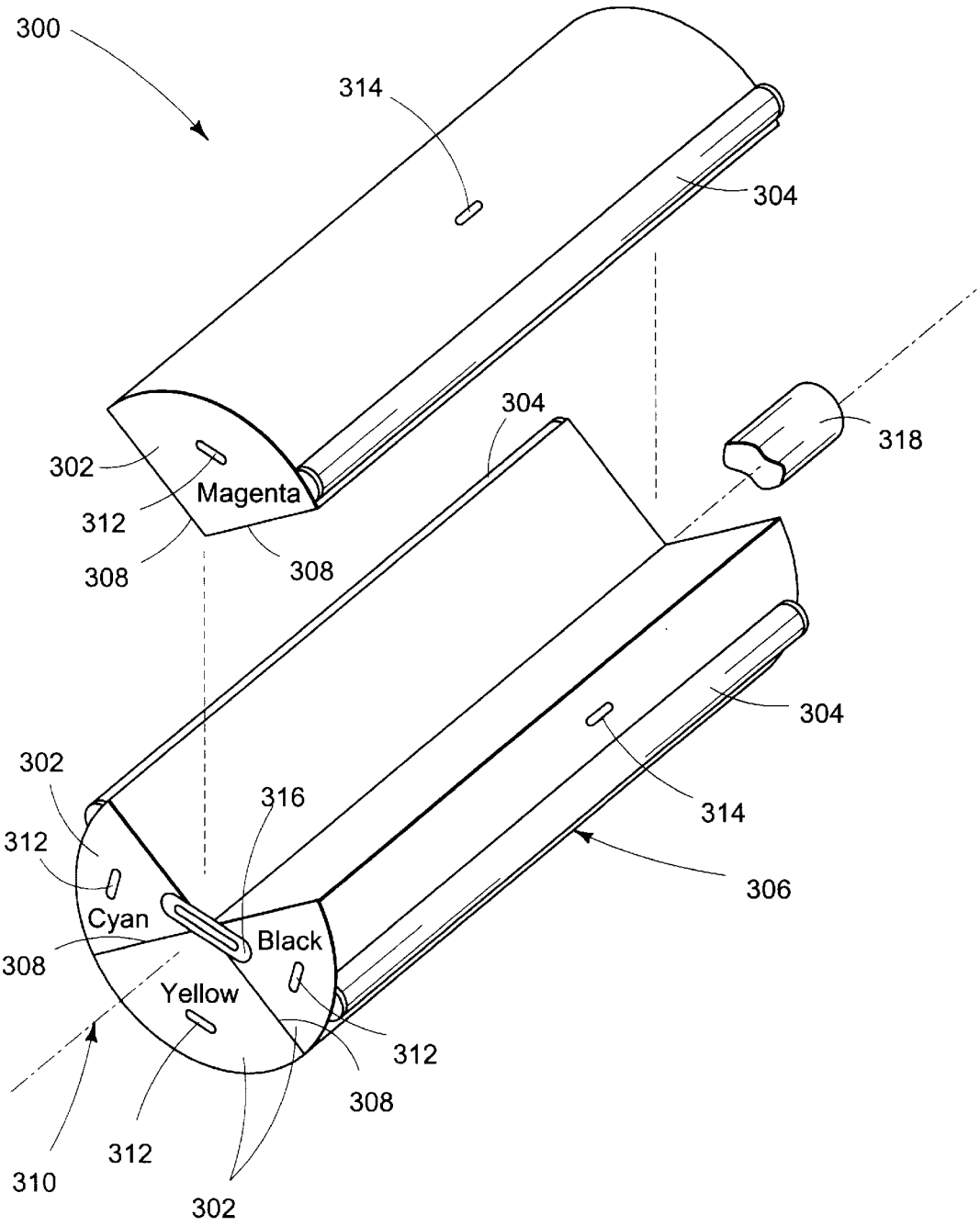
FIG. 3 illustrates an embodiment of an all-in-one toner cartridge having toner sub-cartridges that form a cylinder.

FIG. 3 shows an embodiment of the all-in-one toner cartridge 300 for a color toner-based laser printer. The toner cartridge 300 has four separable color toner containers 302 (or sub-cartridges), one each for the colors cyan, magenta, yellow, and black. Each toner container 302 is illustrated having a developer roller 304. The developer rollers 304 attract a thin layer of toner to their surface from the respective toner containers 302 and transfer the toner particles to the toner transfer drum 202 (FIG. 2) when a particular toner container is rotated and positioned within the printer to deliver toner during a print job.

The four toner containers 302 are replaceable, thus limiting the expense of having to replace the entire toner cartridge 300 to correct a single faulty toner container. While the toner containers 302 are separate and independently replaceable, they are designed to fit together in such a manner that they form the toner cartridge 300 into an integral cylinder 306 when connected to each other.

The toner containers 302 can be interconnected or interlocked along their adjacent edges 308, or at the point where the toner containers 302 fit together to form the central axis 310 of the cylinder 306. In the illustrated embodiment, the containers are connected directly to each other, without any internal or external frame or framework. However, alternative embodiments might utilize internal and/or external frame components to integrate the containers and to allow for engagement of the cylinder within a printing device.

The toner containers 302 are illustrated as pie-shaped sub-cartridges to form the toner cartridge 300 in the shape of a cylinder 306. The shape of a subcartridge 302, from the perspective of the end plane of the sub-cartridge, can also be described as a wedge or as a sector of a circle. A sector of a circle is obtained by taking a cross-sectional portion of a circle having a central angle that is less than pi radians (180 degrees).

The pie-shaped containers 302 extend radially outward from the cylinder axis 310. The outer surfaces of the containers abut each other to form the continuous cylindrical surface of the cartridge 300. Other shapes and configurations are also possible.

In this embodiment, the sub-cartridges 302 can be separated from the toner cartridge 300 by removing the sub-cartridge in a direction that is parallel to the central axis of the cylinder—i.e., sliding the sub-cartridge out one end of the cylinder—or by removing the sub-cartridge in a direction that is perpendicular to the central axis of the cylinder—i.e., pulling the sub-cartridge away from the cylinder in a radial direction. Although the sub-cartridges are illustrated as interconnected pie-shaped containers that form a symmetrically round toner cartridge cylinder, both the toner containers and the resultant toner cartridge cylinder can be one of any number of shapes and configurations.

Figure 3A:
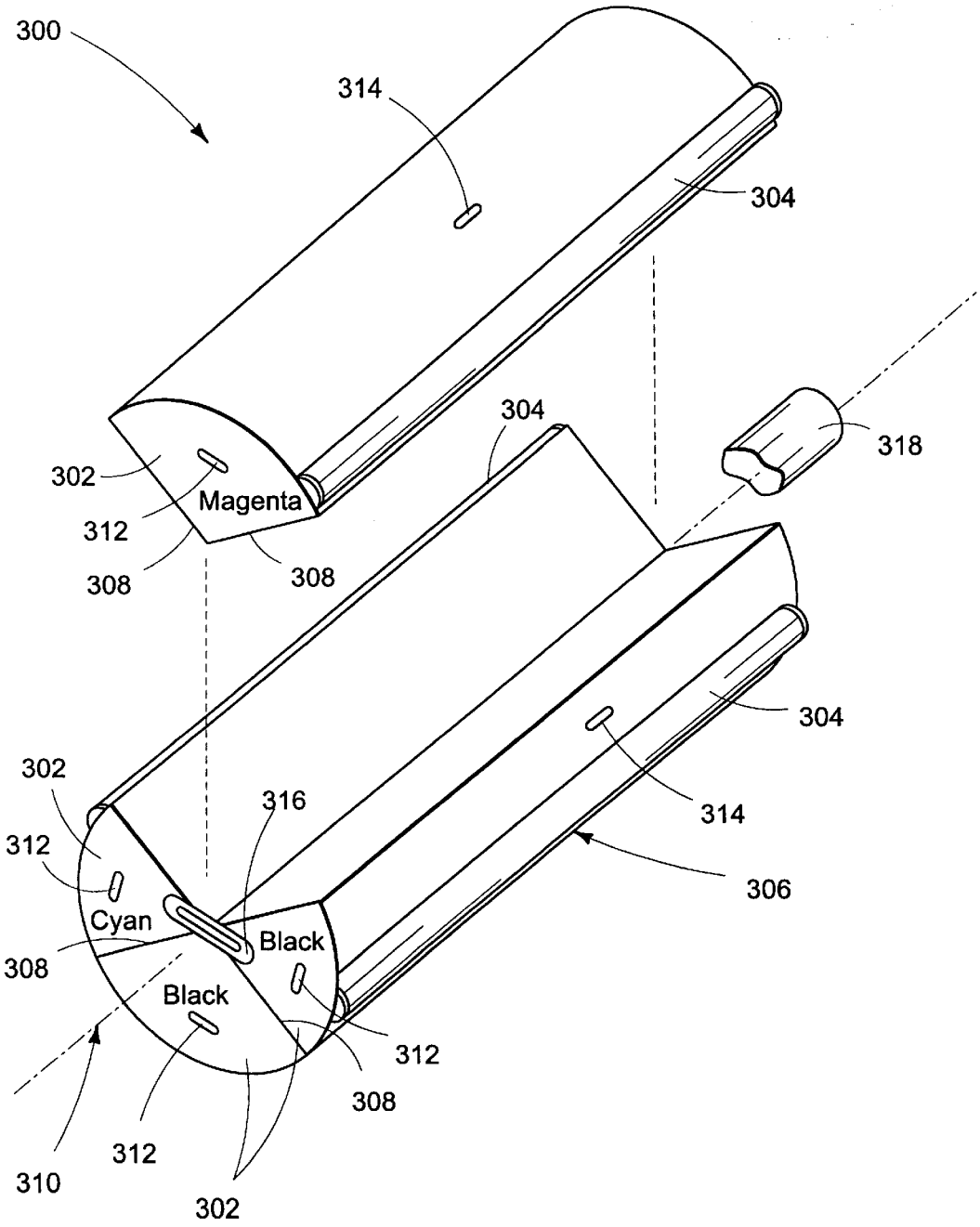
FIG. 3*a* illustrates an embodiment of an all-in-one toner cartridge having toner sub-cartridges, two of the toner sub-cartridges containing the same color toner.

Furthermore, the toner cartridge 300 can also be formed from three, five, or more individual toner containers 302. Also, while each toner container 302 is shown having a different toner color, two or more of the toner containers can contain the same toner color depending upon operational and printing requirements. Such a configuration is shown in FIG. 3*a,* wherein toner cartridge 300 includes one toner container 302 containing magenta toner, one toner container 302 containing cyan toner, and two toner containers 302 that contain black toner.

As well as being replaceable, each toner container 302 is optionally reusable and can be independently refilled with toner. The toner containers 302 are shown having two fill holes each, one fill hole 312 at the end of a toner container, and one fill hole 314 in the side of a toner container. Although only two fill holes are illustrated for each toner container 302, each container can have only one, or any number of fill holes to facilitate differing printing device designs and configurations.

The toner cartridge 300 is illustrated having a handle 316 that can be used to pull the toner cartridge 300 when removing it from a printer, or conversely, used to push the toner cartridge when installing it in a printer. The handle 316 can be designed to interlock the four toner containers 302 at their respective centers, thus creating the one toner cartridge cylinder 306. Those skilled in the art will appreciate that many device interlocking configurations can be contemplated to facilitate securing the toner containers 302 together.

Also shown in FIG. 3 is a shaft and/or gear mechanism 318 that engages within a printing device to effectuate the operation of the toner cartridge 300. The shaft 318 can be a component of the toner cartridge 300, integrated as a component of a printing device to engage the toner cartridge 300 upon installation of the cartridge into the printing device, or the shaft and/or gear mechanism 318 can be independent of both the toner cartridge 300 and the printing device.

Additionally, the shaft 318 can be telescoping such that it will extend and support the toner cartridge 300 when the toner cartridge is removed from the printing device. This facilitates changing or refilling a toner container 302 without having to manually support the toner cartridge 300. Those skilled in the art will appreciate that many component configurations can be contemplated to facilitate engaging the toner cartridge 300 in a printing device, and subsequently rotating the cartridge within the printing device.

Figure 4:
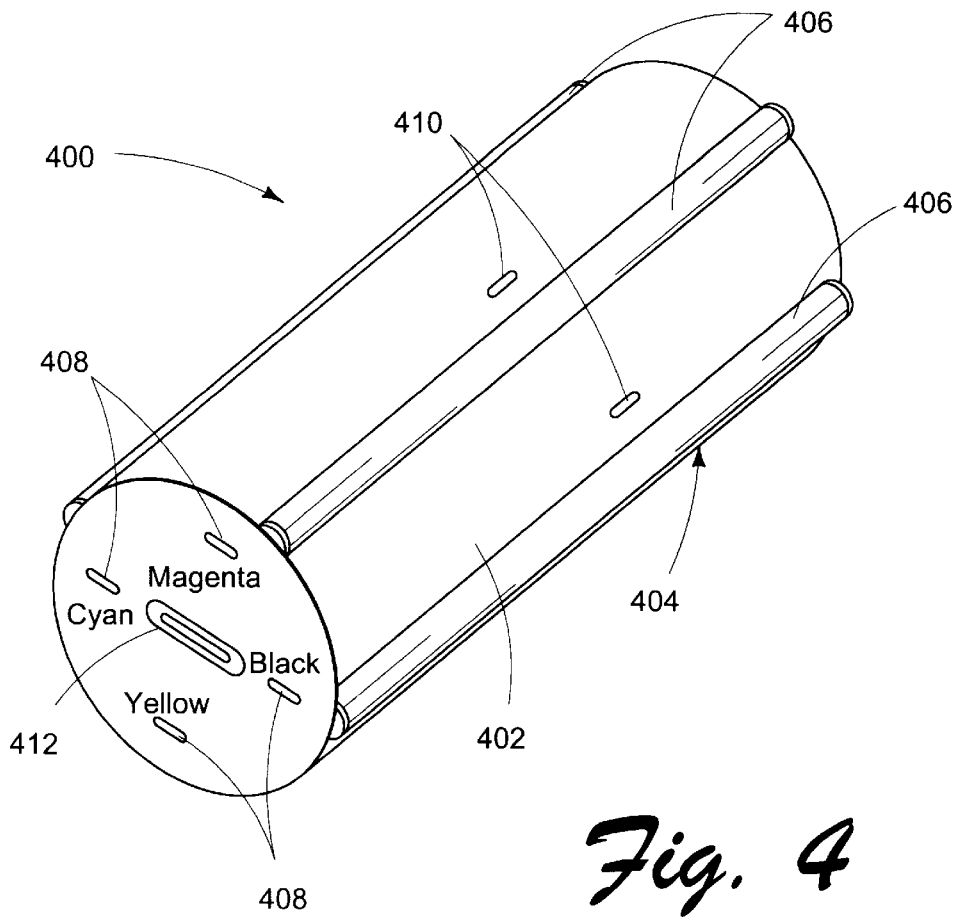
FIG. 4 illustrates an embodiment of an all-in-one toner cartridge having toner containe configured within a housing to form a cylinder.

FIG. 4 illustrates an alternative embodiment of an all-in-one toner cartridge for a color laser toner-based printer, designated by reference numeral 400. In this embodiment, the toner cartridge is a single unit having individual toner containers installed or formed within a housing 402 to form a cylinder 404. As described and illustrated in FIG. 3, the toner cartridge 400 has developer rollers 406, container end fill holes 408, container side fill holes 410, and a handle 412.

Figure 5:
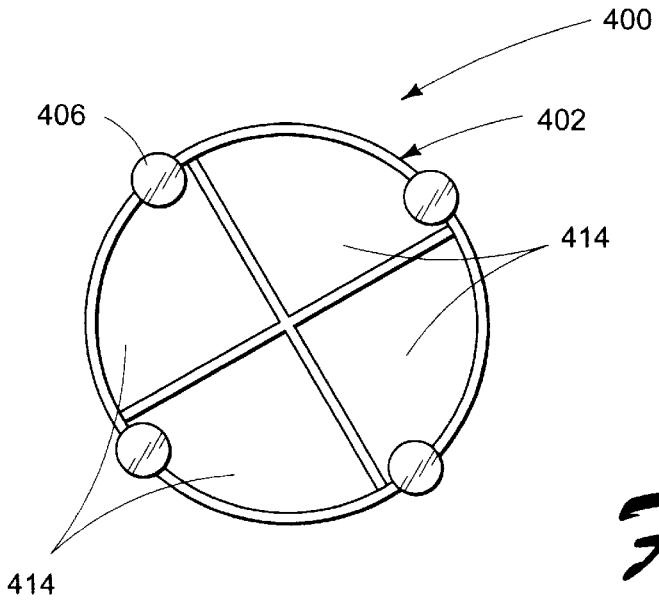
FIG. 5 shows a cross-sectional view of the all-in-one toner cartridge illustrated in FIG. 4.

FIG. 5 shows a cross-section of the toner cartridge 400 (FIG. 4). The toner cartridge 400 has four separable color toner containers 414, one each for the colors cyan, magenta, yellow, and black. The toner containers 414 are shown as four pie-shaped containers that are formed within (e.g., integrated or molded into) the housing 402. Alternatively, the toner containers 414 can be independent sub-cartridges made to slide in and out of the housing 402 for replacement purposes. Once again, although the toner containers 414 are illustrated as pie-shaped containers, both the toner containers and the resultant toner cartridge cylinder can be one of any number of shapes and configurations.

The all-in-one toner cartridge described herein reduces the expenses incurred during manufacture and operation of color laser printers. The simplified design of the toner cartridge is cost-effective to manufacture and operate, and easy to install and to maintain.

Although the invention has been described in language specific to structural features, it is to be understood that the invention defined in the appended claims is not necessarily limited to the specific features described. Rather, the specific features are disclosed as preferred forms of implementing the claimed invention.

I claim:

1. A toner cartridge for use in a toner-based printing device, comprising:

a plurality of toner containers configured to store two or more toners, each toner having a different color, each toner container being independently replaceable within the toner cartridge;

the toner cartridge configured for insertion into and removal from the printing device as a single unit; and the toner cartridge configured to rotate within the printing device to deliver toners from the respective containers.

2. A toner cartridge as recited in claim 1, wherein the toner containers are configured to form the toner cartridge as a cylinder.

3. A toner cartridge as recited in claim 1, wherein the toner containers are independently replaceable and configured to be interconnected to form the toner cartridge as a cylinder.

4. A toner cartridge as recited in claim 1, wherein the toner containers are configured to be operably associated along adjacent edges of the toner containers to form the toner cartridge as a cylinder.

5. A toner cartridge as recited in claim 1, wherein the toner containers are configured to form the toner cartridge as a cylinder, the toner containers configured to be operably associated at a center axis of the cylinder.

6. A toner cartridge as recited in claim 1, wherein two or more of the toner containers contain the same toner color.

7. A toner cartridge as recited in claim 1, wherein the toner containers are configured to be individually refilled with toner.

8. A toner cartridge for use in a laser printer to expose one or more different toners to a rotating toner transfer drum, comprising:

a cylinder configured from a plurality of toner containers that extend across the cylinder in a direction parallel to a center axis of the cylinder, the toner containers configured to contain one or more different toners and to be individually replaceable within the toner cartridge;

the cylinder configured to rotate within the printer to select toners from the respective containers for exposure to the rotating toner transfer drum; and the cylinder configured for insertion into and removal from the printer as a single unit.

9. A toner cartridge as recited in claim 8, wherein the toner containers are independently replaceable, pie-shaped containers configured to be operably associated to form the cylinder.

10. A toner cartridge as recited in claim 8, wherein the toner containers are configured to be operably associated along adjacent edges of the toner containers to form the cylinder.

11. A toner cartridge as recited in claims 8, wherein the toner containers are configured to be operably associated at a point where the toner containers form the axis of the cylinder.

12. A toner cartridge as recited in claim 8, wherein the toner containers are configured to be individually refilled with toner.

13. A toner cartridge for use in a laser printer to expose one or more different toners to a rotating toner transfer drum, comprising:

a plurality of pie-shaped sub-cartridges that are interconnected to form a cylinder, the sub-cartridges configured to contain one or more different toners;

the cylinder configured to rotate within the printer to select toners from the respective sub-cartridges for exposure to the rotating toner transfer drum;

the cylinder configured for insertion into and removal from the printer as a single unit; and.

the pie-shaped sub-cartridges of the cylinder being independently replaceable upon removing the cylinder from the printer.

14. A toner cartridge as recited in claim 13, wherein the sub-cartridges are configured to be individually refilled with toner.

15. A toner cartridge as recited in claim 13, wherein the sub-cartridges are configured to be operably associated along adjacent edges of the sub-cartridges to form the cylinder.

16. A toner cartridge as recited in claim 13, wherein the sub-cartridges are configured to be operably associated at a point where the sub-cartridges form a center axis of the cylinder.

17. A laser printer, comprising:

a rotating toner transfer drum having a surface configured to attract toner and to apply said toner to a print medium;

a replaceable toner cartridge that exposes the rotating toner transfer drum to the toner, the replaceable toner cartridge having a plurality of independently replaceable toner containers and being rotatable to select one of a plurality of different toners for exposure to the rotating toner transfer drum, the replaceable toner cartridge configured for removal as a single unit from the printer.

18. A toner cartridge as recited in claim 17, wherein the toner containers are configured to be individually refilled with toner.

19. A laser printer as recited in claim 17, wherein the toner containers are configured to form the toner cartridge as a cylinder.

20. A laser printer as recited in claim 17, wherein two or more of the toner containers contain the same toner color.

* * * * *